US005392969A

United States Patent [19]

Usery

[11] Patent Number: 5,392,969

[45] Date of Patent: Feb. 28, 1995

[54] POURING ATTACHMENT FOR A PAINT CAN

[76] Inventor: Charles E. Usery, 206 Aldergate St., Farmington, Mo. 63640

[21] Appl. No.: 199,997

[22] Filed: Feb. 22, 1994

[51] Int. Cl.[6] ..... B65D 25/48

[52] U.S. Cl. ..... 222/570; 220/695; 220/701

[58] Field of Search ..... 222/567, 569, 570; 220/695–698, 700, 701, 731, 733

[56] References Cited

U.S. PATENT DOCUMENTS

| | | | |
|---|---|---|---|
| 1,865,736 | 7/1932 | Astley | 220/701 X |
| 2,591,482 | 4/1952 | Weltich | 220/733 X |
| 2,660,333 | 11/1953 | Paxton | 220/733 X |
| 2,665,029 | 1/1954 | Horrocks | 220/695 |
| 2,731,178 | 1/1956 | Larsson | 220/731 X |
| 2,873,052 | 2/1959 | Atherton | 220/695 X |
| 3,309,000 | 3/1967 | Haverstick | 222/569 |
| 3,326,409 | 6/1967 | Speer | 220/698 |
| 3,688,943 | 9/1972 | Brown | 220/698 X |
| 3,980,213 | 9/1976 | Ramsey | 220/700 X |
| 4,116,332 | 9/1978 | Hartley | 220/700 X |

*Primary Examiner*—Kevin P. Shaver

[57] ABSTRACT

A new and improved pouring attachment for a paint can comprising an arcuate section having an interior surface, an exterior surface, a bottom edge, a top edge, a first side and a second side. The surface of the section is sloped inwardly from the top edge to the bottom edge. A first planar sidewall has an interior surface, an exterior surface,a bottom edge, a top edge, a first side and a second side, the first side of the first planar sidewall being integral with the first side of the arcuate section. An arcuate pouring section has an interior surface, an exterior surface, a bottom edge, a top edge, a first side and a second side. The surface of the section is sloped inwardly from the top edge to the bottom edge. The first side of the pouring arcuate section is integral with the second side of the first planar sidewall. A second planar sidewall has an interior surface, an exterior surface, a bottom edge, a top edge, a first side and a second side. The first side of the second planar sidewall is integral with the second side of the arcuate section, and the second side of the second planar sidewall is integral with the second side of the pouring arcuate section.

1 Claim, 2 Drawing Sheets

POURING ATTACHMENT FOR A PAINT CAN

BACKGROUND OF THE INVENTION

1. Field of the Invention

The present invention relates to pouring attachment for a paint can and more particularly pertains to an attachment which keeps paint from spilling over the side of the paint can.

2. Description of the Prior Art

The use of paint can attachments is known in the prior art. More specifically, paint can attachments heretofore devised and utilized for the pouring of paint are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,137,188 to Thompson discloses a pouring extension for a liquid containing can. A number of projections are formed integrally with the bottom portion of the body to allow the extension to be inserted into an open can.

U.S. Pat. No. Des. 254,482 to Bell discloses an ornamental design for a pouring attachment of paint cans.

U.S. Pat. No. 5,072,847 to Price discloses a filler/-cover for the perimeter groove area of a paint can where the lid seal is made. The filler/cover further includes a lip to enhance dripless pouring from the container.

U.S. Pat. No. 3,822,812 to Shorin et al. discloses a pouring attachment for paint cans. The pouring device is adapted to be mounted by adhesive attachment over the rim of the paint can.

U.S. Pat. No. 4,813,579 to Ciumaga discloses a paint can pouring spout. The pouring spout is adapted to snap easily onto a typical paint can rim.

In this respect, the pouring attachment for a paint can according to the present invention substantially departs from the conventional concepts and designs of the prior art, and in doing so provides an apparatus primarily developed for the purpose of prohibiting paint from spilling over the edge of a paint can.

Therefore, it can be appreciated that there exists a continuing need for a new and improved pouring attachment for a paint can which can be used for prohibiting paint from spilling over the edge of a paint can. In this regard, the present invention substantially fulfills this need.

SUMMARY OF THE INVENTION

In view of the foregoing disadvantages inherent in the known types of paint can attachments now present in the prior art, the present invention provides an improved pouring attachment for a paint can. As such, the general purpose of the present invention, which will be described subsequently in greater detail, is to provide a new and improved pouring attachment for a paint can and method which has all the advantages of the prior art and none of the disadvantages.

To attain this, the present invention essentially comprises a new and improved pouring attachment for a paint can. The attachment includes an arcuate section having an interior surface, an exterior surface, a bottom edge, a top edge, a first side and a second side. The surface of the section is sloped inwardly from the top edge to the bottom edge. A first planar sidewall has an interior surface, an exterior surface, a bottom edge, a top edge, a first side and a second side. The first side of the first planar sidewall being integral with the first side of the arcuate section. An arcuate pouring section has an interior surface, an exterior surface, a bottom edge, a top edge, a first side and a second side. The surface of the section is sloped inwardly from the top edge to the bottom edge. A pouring lip is positioned intermediate the first and second sides of the section and extends from the top edge to a position intermediate the top and bottom edges. The first side of the pouring arcuate section is integral with the second side of the first planar sidewall. A second planar sidewall has an interior surface, an exterior surface, a bottom edge, a top edge, a first side and a second side. The first side of the second planar sidewall is integral with the second side of the arcuate section, and the second side of the second planar sidewall is integral with the second side of the pouring arcuate section. The bottom edges of the arcuate sections and the bottom edges of the planar sidewalls together form a sealing surface adapted to be inserted into the groove of a standard paint can.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pouring attachment for a paint can which has all the advantages of the prior art paint can attachments and none of the disadvantages.

It is another object of the present invention to provide a new and improved pouring attachment for a paint can which may be easily and efficiently manufactured and marketed.

It is further object of the present invention to provide a new and improved pouring attachment for a paint can which is of durable and reliable constructions.

An even further object of the present invention is to provide a new and improved pouring attachment for a paint can which is susceptible of a low cost of manufacture with regard to both materials and labor, and which accordingly is then susceptible of low prices of sale to the consuming public, thereby making such pouring attachment for a paint can economically available to the buying public.

Still yet another object of the present invention is to provide a new and improved pouring attachment for a paint can which provides in the apparatuses and methods of the prior art some of the advantages thereof, while simultaneously overcoming some of the disadvantages normally associated therewith.

Even still another object of the present invention is to create an attachment which prohibits paint from spilling over the edge of a paint can.

Lastly, it is an object of the present invention to provide a new and improved pouring attachment for a paint can comprising an arcuate section having an interior surface, an exterior surface, a bottom edge, a top edge, a first side and a second side. The surface of the section is sloped inwardly from the top edge to the bottom edge. A first planar sidewall has an interior surface, an exterior surface,a bottom edge, a top edge, a first side and a second side. The first side of the first planar sidewall is integral with the first side of the arcuate section. An arcuate pouring section has an interior surface, an exterior surface, a bottom edge, a top edge, a first side and a second side. The surface of the section is sloped inwardly from the top edge to the bottom edge. The first side of the pouring arcuate section is integral with the second side of the first planar sidewall. A second planar sidewall has an interior surface, an exterior surface, a bottom edge, a top edge, a first side and a second side. The first side of the second planar sidewall is integral with the second side of the arcuate section, and the second side of the second planar sidewall is integral with the second side of the pouring arcuate section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
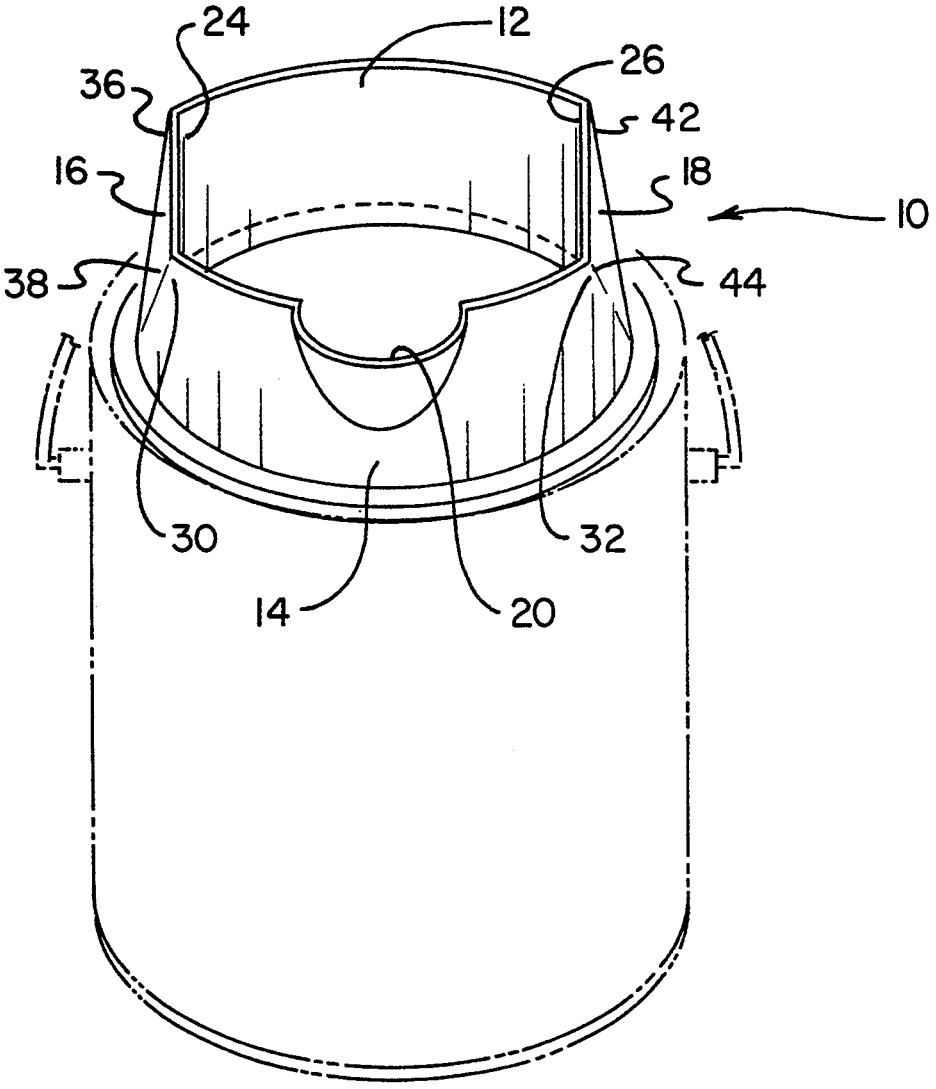
FIG. 1 is a perspective view of the preferred embodiment of the pouring attachment for a paint can constructed in accordance with the principles of the present invention.
Figure 2:
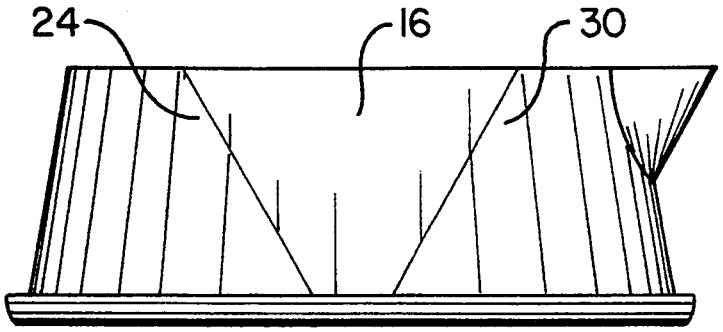
FIG. 2 is a side elevational view of the attachment in accordance with the first embodiment of the present invention.
Figure 3:
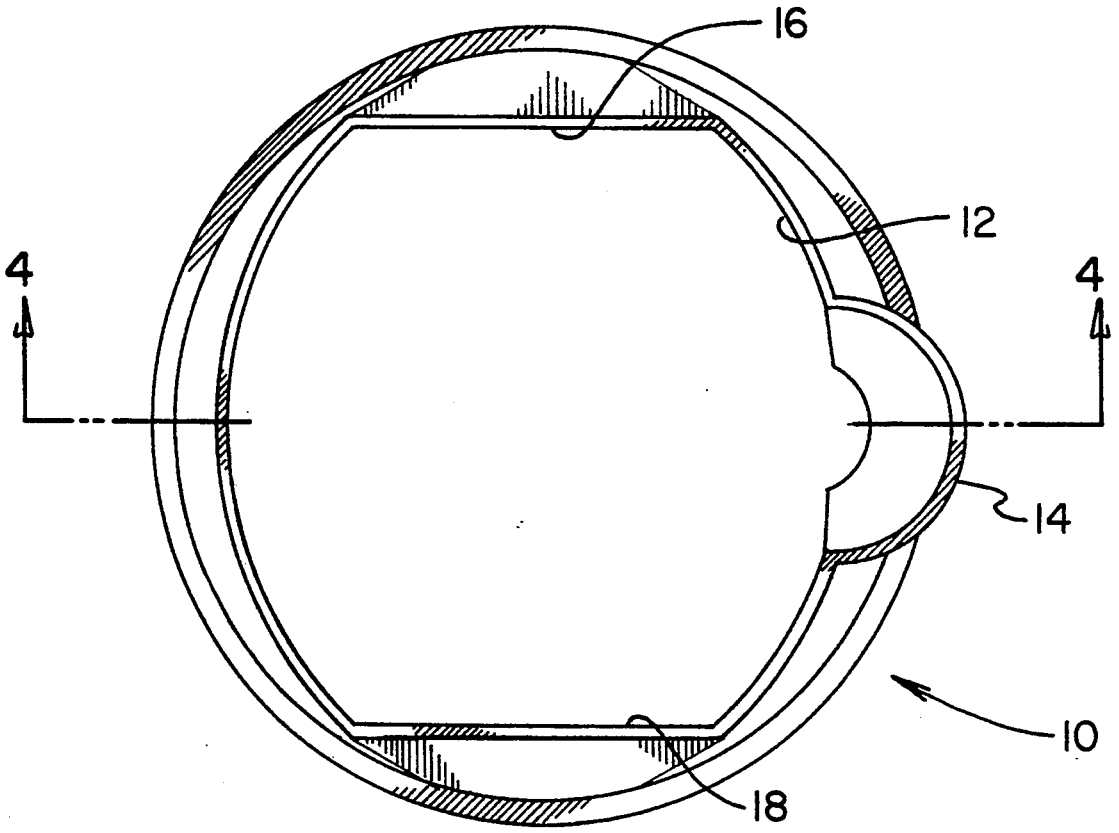
FIG. 3 is a plan view of the attachment in accordance with the first embodiment of the present invention.
Figure 4:
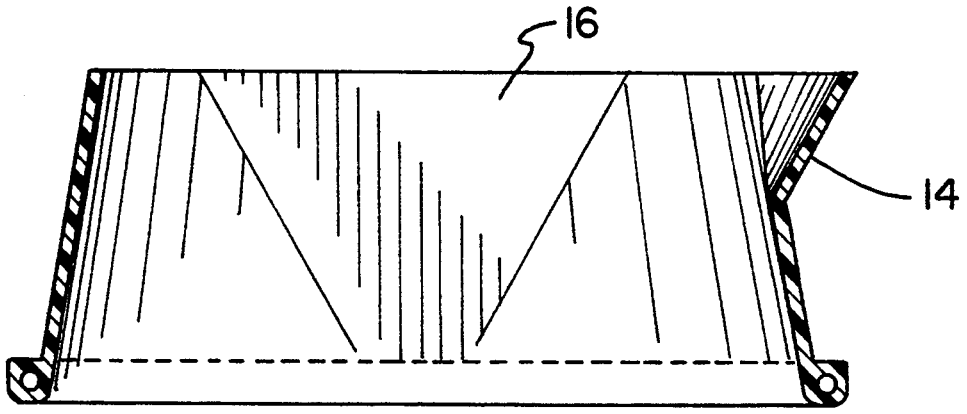
FIG. 4 is a cross sectional view taken along line 4—4 of FIG. 3.

With reference now to the drawings, and in particular to FIG. 1 thereof, the preferred embodiment of the new and improved pouring attachment for a paint can embodying the principles and concepts of the present invention and generally designated by the reference numeral 10 will be described.

The present invention relates to a new and improved pouring attachment 10 for a paint can. Note in particular FIGS. 1 through 4. The attachment 10 is an extension that fits into the circumferential groove about the opening of a conventional paint can. This attachment 10 is somewhat funnel shaped, and thus it reduces the amount of paint that is spilled over the edge of the paint can. The attachment 10 of the present invention also provides an edge upon which a painter can scrape his or her brush. Furthermore, the attachment 10 of the present invention provides a pouring lip 20 upon its forward edge to facilitate pouring of paint from the paint can. The entire attachment 10 is molded from a plastic material in a one piece construction.

In its broadest context, the present invention includes a first arcuate portion 12, a pouring arcuate portion 14, a first planar sidewall 16 and a second planar sidewall 18. The arcuate portions 12 and 14 and the planar sidewalls 16 and 18 together form the attachment 10 of the present invention. The specific design and construction of the attachment 10 will be described more fully hereafter.

The arcuate section 12 includes an interior surface, an exterior surface, a bottom edge, a top edge, a first side 24 and a second side 26. The surface of the section is sloped inwardly from its top edge to its bottom edge.

The first planar sidewall 16 includes an interior surface, an exterior surface, a bottom edge, a top edge, a first side 36 and a second side 38. The first side 36 of the first planar sidewall 16 is integral with the first side 24 of the arcuate section 12.

The arcuate pouring section 14 includes an interior surface, an exterior surface, a bottom edge, a top edge, a first side 30 and a second side 32. As with the other arcuate section, the surface of the section is sloped inwardly from its top edge to its bottom edge. The pouring section further includes, a pouring lip 20 positioned intermediate the first and second sides of the section. The lip 20 extends from the top edge to a position intermediate the top and bottom edges. The first side 30 of the pouring arcuate section 14 is integral with the second side 32 of the first planar sidewall 16.

The second planar sidewall 18 includes an interior surface, an exterior surface, a bottom edge, a top edge, a first side 42 and a second side 44. The first side 42 of the second planar sidewall 18 is integral with the second side 26 of the arcuate section 12. Furthermore, the second side 44 of the second planar sidewall 18 is integral with the second side 32 of the pouring arcuate section 14.

The bottom edges of the arcuate sections and the bottom edges of the planar sidewalls together form a sealing surface. This surface is adapted to be inserted into the groove about the opening of a standard size paint can.

The attachment in accordance with the first embodiment is designed to be placed on a paint can while it is in use. It is made of plastic and simply formed as a ring which is snapped into place within the groove for the paint can cover when it is removed. The ring has an inwardly flared flange around its entire periphery and a formed spout. This spout is located centrally between two diametrically opposed flat sections which serve as clearance for the paint can handle.

From the foregoing description, it can be seen that, when painting directly from the can, one can wipe the brush across the top of the attachment and excess paint will gradually drip back into the can. It will not collect in the groove of the can which must be clean if a positive seal is to be obtained upon reinstallation of the cover. The attachment will also prevent spills while the paint is being stirred, and the convenient spout facilitates pouring paint into another receptacle with no mess. When the job is complete, it is a simple matter to remove the attachment and quickly clean it under a faucet or with proper solvent as dictated by the base of the paint used. It can be offered in sized to fit the standard 1-quart and 1-gallon paint containers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved pouring attachment for a paint can comprising, in combination:

an arcuate section having an interior surface, an exterior surface, a bottom edge, a top edge, a first side and a second side, the surface of the section being sloped inwardly from the top edge to the bottom edge;

a first planar sidewall in a generally triangular configuration having an interior surface, an exterior surface, a bottom edge, a linear top edge, a first side and a second side, the first side of the first planar sidewall being integral with the first side of the arcuate section;

an arcuate pouring section having an interior surface, an exterior surface, a bottom edge, a top edge, a first side and a second side, the surface of the section being sloped inwardly from the top edge to the bottom edge, a pouring lip positioned intermediate the first and second sides of the section and extending from the top edge to a position intermediate the top and bottom edges, the first side of the pouring arcuate section being integral with the second side of the first planar sidewall;

a second planar sidewall in a generally triangular configuration having an interior surface, an exterior surface, a bottom edge, a linear top edge parallel with the linear top edge of the first planar side wall, a first side and a second side, the first side of the second planar sidewall being integral with the second side of the arcuate section, and the second side of the second planar sidewall being integral with the second side of the pouring arcuate section, the pouring section being located equidistant from the linear top edges of the first and second planar sidewalls with the linear top edges being closer together than the bottom edges;

the bottom edges of the arcuate sections and the bottom edges of the planar sidewalls together forming a sealing surface adapted to be inserted into the groove of a standard paint can.

* * * * *